US005836591A

United States Patent [19]

Roderick et al.

[11] Patent Number: 5,836,591

[45] Date of Patent: Nov. 17, 1998

[54] IN-LINE WHEELED SKATE FOR EXTREME SKATING

[75] Inventors: John A. Roderick, Scituate; David R. Willis, Wakefield, both of R.I.

[73] Assignee: Mearthane Products Corporation

[21] Appl. No.: 731,249

[22] Filed: Oct. 11, 1996

[51] Int. Cl.[6] ..... A63C 17/06

[52] U.S. Cl. ..... 280/11.22; 280/11.2; 280/11.23; 280/11.27; 301/5.3

[58] Field of Search ..... 280/11.22, 11.19, 280/11.23, 11.27, 842, 11.28, 293, 809, 811, 87.042; 301/5.3

[56] References Cited

U.S. PATENT DOCUMENTS

| | | | |
|---|---|---|---|
| 1,332,702 | 3/1920 | Wisniewski | 280/841 |
| 3,522,951 | 8/1970 | Tyson | 280/843 |
| 3,936,061 | 2/1976 | Wada | 280/11.23 |
| 4,618,158 | 10/1986 | Liberkowski | 280/11.1 |
| 5,566,958 | 10/1996 | Sinelnikov | 280/11.22 |

FOREIGN PATENT DOCUMENTS

| | | |
|---|---|---|
| WO 93/20912 | 10/1993 | WIPO . |
| PCT/US97/18409 | 2/1998 | WIPO . |

OTHER PUBLICATIONS

Rollerpro® advertisement (from the Internet http://www.goskate@rollerpro.com) Jun. 17, 1997 Pub. Date.

*Primary Examiner*—Brian L. Johnson
*Assistant Examiner*—Michael Mar
*Attorney, Agent, or Firm*—Fish & Richardson P.C.

[57] ABSTRACT

An in-line wheeled skate which includes a rolling element between the wheels that enables the skater to jump up on a rail and roll down the rail sideways, as in 'extreme skating' maneuvers, by placing the skate on the rail with the rolling element bearing upon the rail surface. Adjustable brakes provide control of the speed of sideways motion. The rolling element is provided as part of an attachment or lower structure to be secured to an in-line skate.

4 Claims, 12 Drawing Sheets

IN-LINE WHEELED SKATE FOR EXTREME SKATING

BACKGROUND OF THE INVENTION

The most competent or daring who use in-line roller skates perform acrobatic maneuvers. Some of the more difficult maneuvers, commonly referred to as 'extreme skating', include sliding sideways down a stair bannister rail or similar structure. The skater jumps onto a stair bannister with his skates sideways on the bannister, the bannister rail positioned under the skate frame between the second and third wheels of a four-wheeled skate. In this position, the skater slides, standing on the skates, down the rail. As this motion is substantially parallel to the axes of the wheels, the skater is essentially skidding, instead of rolling, down the railing. In popular vernacular, they are 'grinding'. In some instances, the skaters use existing rails found in public places and in other instances railings are constructed specifically for this use.

To accommodate extreme skating, it is common to install 'grinding plates' to the sides of the roller frame between the second and third rollers. These plates commonly are scalloped to accept a curved rail surface, and provide a wear surface against the bannister. The concave shape of the plate helps the skater to stay on the railing and it also prevents damage to the skate.

As a form of recreation, it is desired to reduce risk while the most avid extreme skaters desire higher speeds within safe limits and the ability to perform a greater variety of feats.

SUMMARY OF THE INVENTION

We have realized that grinding plates provide undesirable characteristics and that good performance can be achieved by employing a rolling member or members to engage the rail, and that it is possible to provide such a feature in a practical manner in a skate that can otherwise perform satisfactorily.

In one aspect of the invention, an in-line wheeled skate is provided, the skate comprising a frame, at least two wheels positioned in-line along the frame, each wheel rotatable about a wheel axis, and at least one rolling element positioned substantially between the wheels. The rolling element is rotatable about an axis which is substantially perpendicular to the wheel axes, such that the skate may roll along a rail or other support positioned against the rolling element.

In one embodiment of the invention, the rolling element is an elongated member. Preferably, the elongated outer surface of the rolling element is substantially concave such that the diameter of the rolling element at its midpoint is less than the diameter of the rolling element near its ends.

In another configuration a pair of rolling elements is provided, the rail being positionable between and in contact with both rolling elements, thus enabling the skate to roll along the rail against the rolling elements.

In one such embodiment, the rolling elements are spherical.

In preferred embodiments the skate further comprises a brake to provide drag to the rolling element. A brake adjuster is provided in some advantageous embodiments to enable the amount of engagement of the brake to be adjusted. In a preferred configuration, the brake adjuster comprises a rotatable set screw. In some cases, the brake is operable by application of fluid pressure.

In another configuration, the skate comprises four in-line wheels.

According to another aspect of the invention, an attachment is constructed and arranged to be secured to the lower structure of an in-line wheeled skate, the attachment comprising at least one rolling element arranged to be positioned substantially between wheels of the skate. The rolling element is rotatable about an axis which is substantially perpendicular to the axes of said wheels, such that the skate may roll along a rail or other support upon which the rolling element bears.

In some embodiments of this aspect of the invention, the attachment is constructed and arranged to replace at least one centrally located skate wheel. In some cases, the attachment includes at least one wheel positioned such that when the attachment is secured to the skate the lower surface of the wheel of the attachment is substantially aligned with the plane defined by the lower surfaces of the skate wheels.

According to another aspect of the invention, a lower structure for an in-line wheeled skate is provided, the structure comprising a frame, at least two wheels positioned in-line along the frame, each wheel rotatable about a wheel axis, and at least one rolling element positioned substantially between the wheels. The rolling element is rotatable about an axis which is substantially perpendicular to the wheel axes, such that the skate may roll along a rail or other support upon which the rolling element bears. The structure is constructed and arranged to be secured to the boot portion of the skate.

DESCRIPTION OF THE PREFERRED EMBODIMENTS

Figure 1:
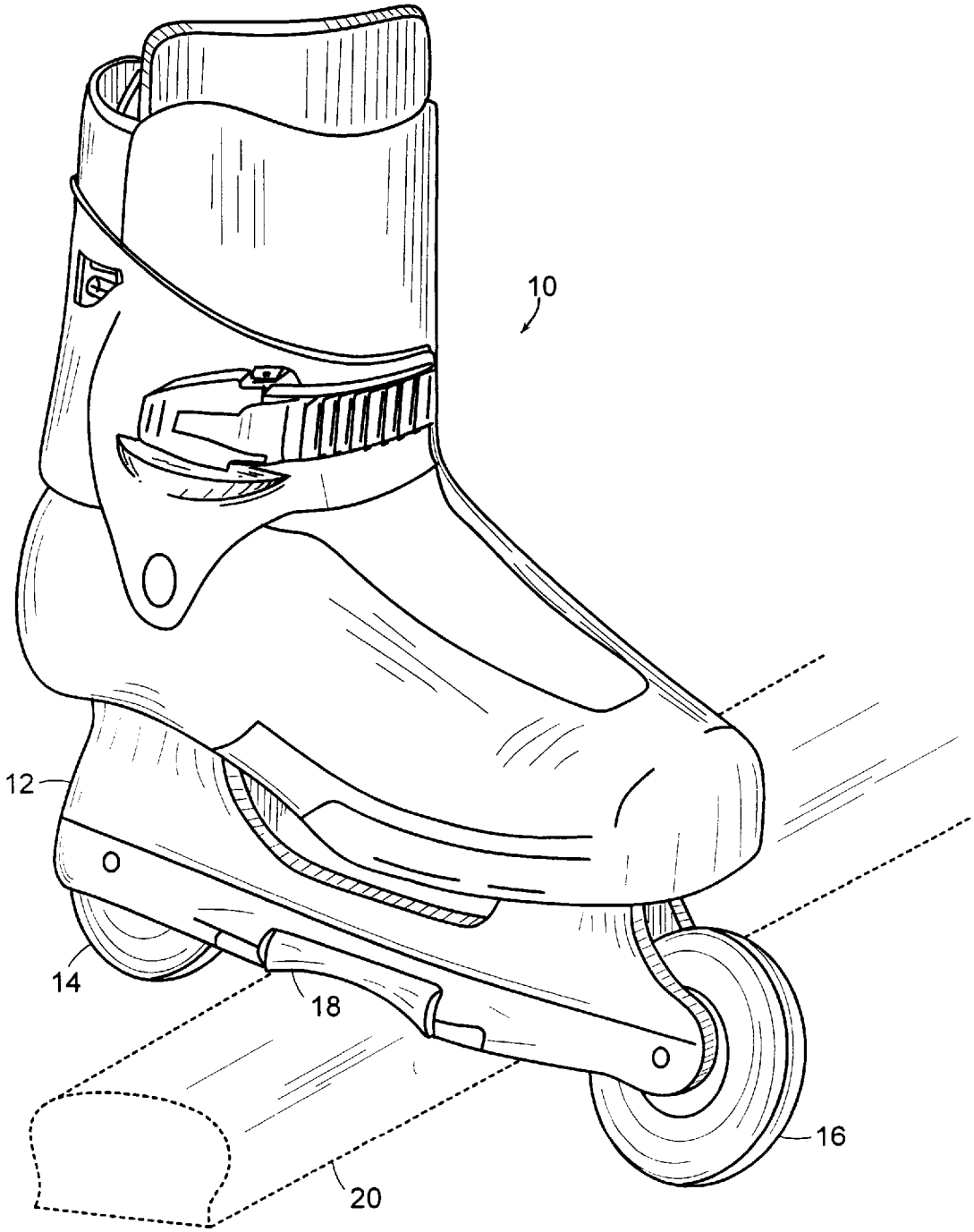
FIG. 1 is a perspective view of an in-line wheeled skate, according to the invention.

The figures illustrate various embodiments of the in-line wheeled skate 10 of the present invention. In the first embodiment, shown in FIGS. 1 and 2, a rotatable elongated roller 18 is mounted to the wheel frame 12 between two in-line mounted wheels 14 and 16 to allow the skater to roll, rather than skid, sideways along a rail 20. In this embodiment, the inner two wheels of a standard four wheel configuration have been removed to provide room for the roller 18. The roller as shown has a concave outer surface to help to keep the skater centered on the rail. The elongated roller may also be substantially cylindrical.

The roller 18 has an axis 22 of rotation perpendicular to the axes 24 of rotation of the wheels 14 and 16, so that the skate can still function as a normal in-line skate with the wheels in loaded contact with the pavement, yet additionally to enable the skate to roll down a rail upon the roller 18 with the wheels not under load. Two load-bearing end shafts 26 and 28 define the axis 22 of rotation of the roller. The shafts are confined by roller clips 30 attached to the frame 12 with fasteners 32 to define cavities 31 between the clips and the frame. The fasteners and clips can be removed to replace the roller. The shafts 26 and 28 transfer the force of contact with the rail to the skate frame 12.

Figure 2:
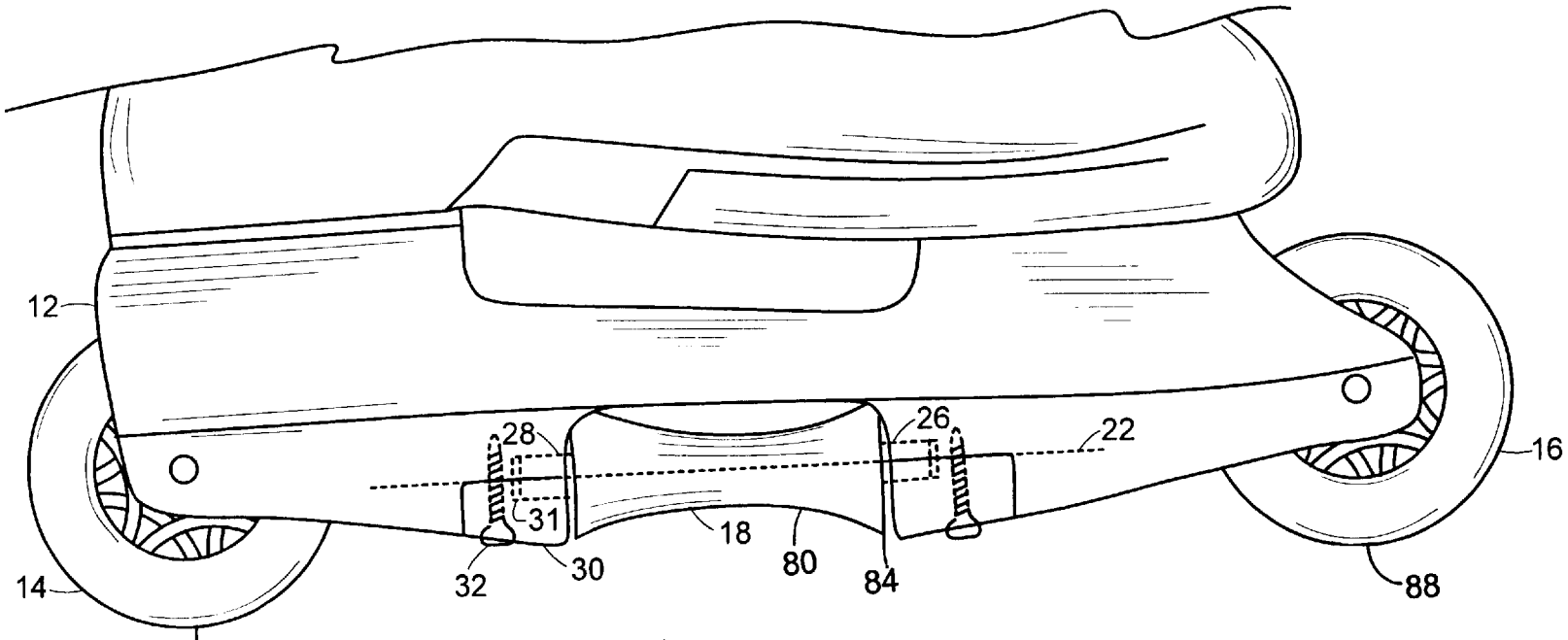
FIG. 2 is a side elevation of a first embodiment.
Figure 3:
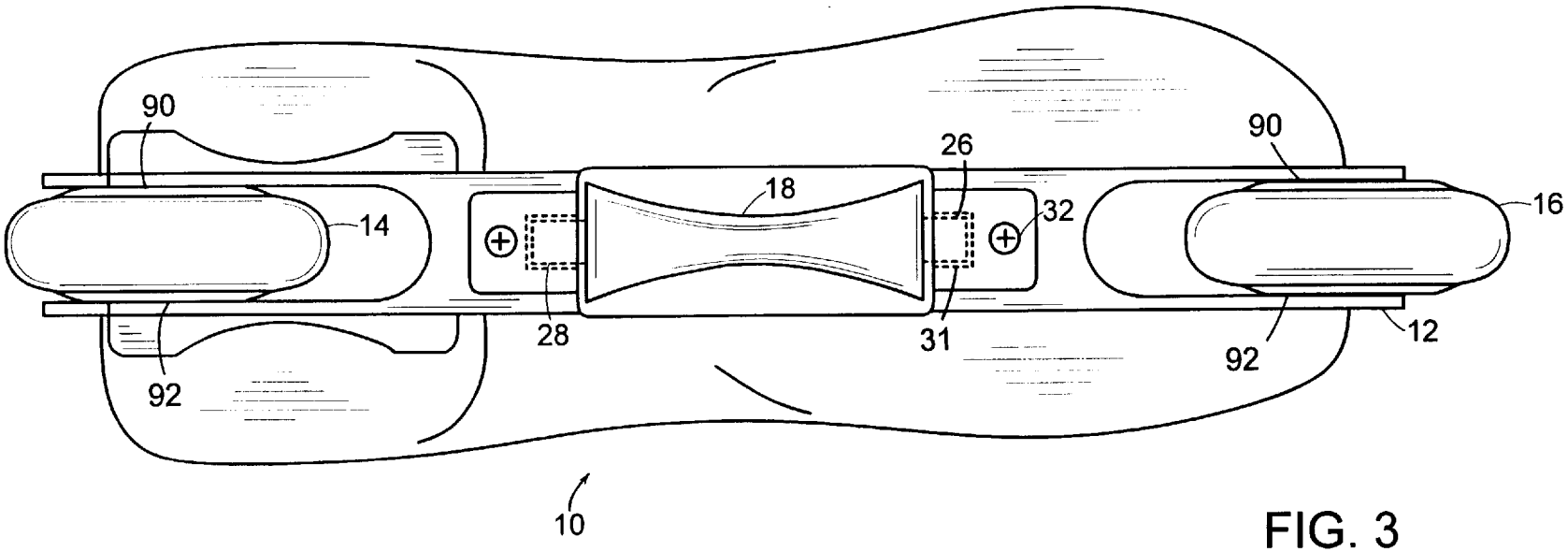
FIG. 3 is a bottom view of the first embodiment.

As shown in FIG. 2, elongated roller 18 is positioned between wheels 14, the roller being mounted to frame 12 for rotation about a single axis 22 extending in the longitudinal direction of the frame. Roller 18 has an outer engagement surface 80 configured for rolling contact with an elongated supporting surface (e.g., a rail 20, FIG. 1) extending transversely between wheels 14 for permitting the skate to travel in a direction extending perpendicular to the longitudinal direction of the frame, a lowermost portion 84 of the outer engagement surface 80 of the roller being positioned vertically higher than a ground plane defined by lowermost portions 88 of wheels 14. As shown in FIG. 3, the rotational axis of the roller is disposed between left and right longitudinal side planes defined by left and right lateral sides 90 and 92 of wheels 14. In FIG. 3, roller 18 is shown with its rotational axis substantially centered between the left and right longitudinal side planes of the wheels.

FIG. 9A–9F illustrate some rail configurations on which the skate of the present invention may be used. The roller slide design allows the skater to slide in a more upright position. Previous designs require the skater to lean onto the side or edge of the skate. A more upright skating stance provides the skater more maneuverability. This may add to the tricks the skater can perform. Transitions from different inclines become possible. The rail configuration of FIG. 9E includes a curved horizontal plane 94.

In some instances the clip fasteners 32 are constructed to be adjustably tightened to provide a desired amount of drag against shafts 26 and 28 within cavities 31 to serve as brakes to slow the speed of the roller by friction for situations where such friction is advantageous.

Figure 4:
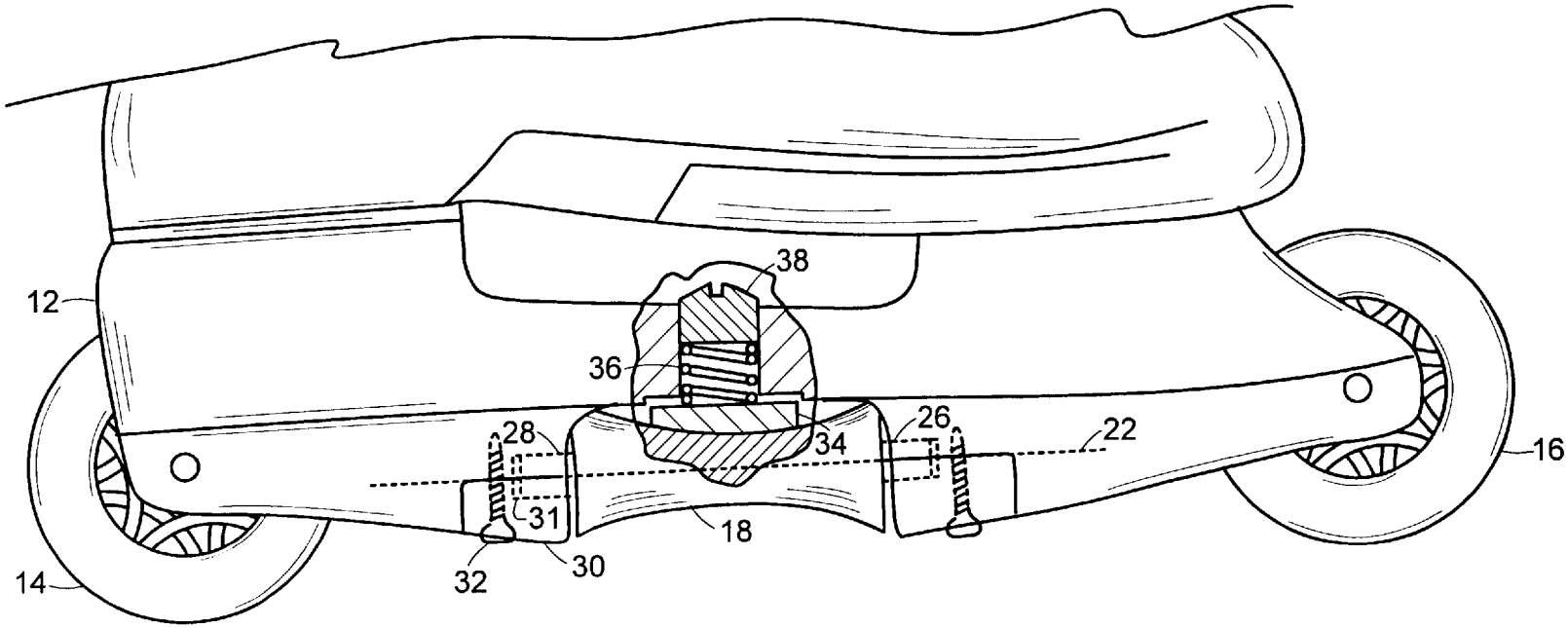
FIG. 4 is a side elevation of a second embodiment, with a portion removed to show a brake.

In other preferred configurations, a separate brake 34 is provided above the roller, as shown in FIG. 4, to slow the speed of the skater along the rail. The brake is held against the roller by a brake spring 36. The nominal force of the spring 36 against the brake 34, and therefore the brake force, is adjustable by turning a threaded set screw 38 against the spring. In this manner the amount of braking is adjustable according to the skater's preference and personal skill level. As with the rolling element 18, the brake 34 is replaced when worn by removing clips 30.

In some instances the roller 18 and brake 34 are housed in a separate roller housing 40 that is attachable to the frame of an existing four-wheel in-line skate by removing the inner two wheels and attaching the roller housing to the skate frame with fasteners 42.

Figure 5:
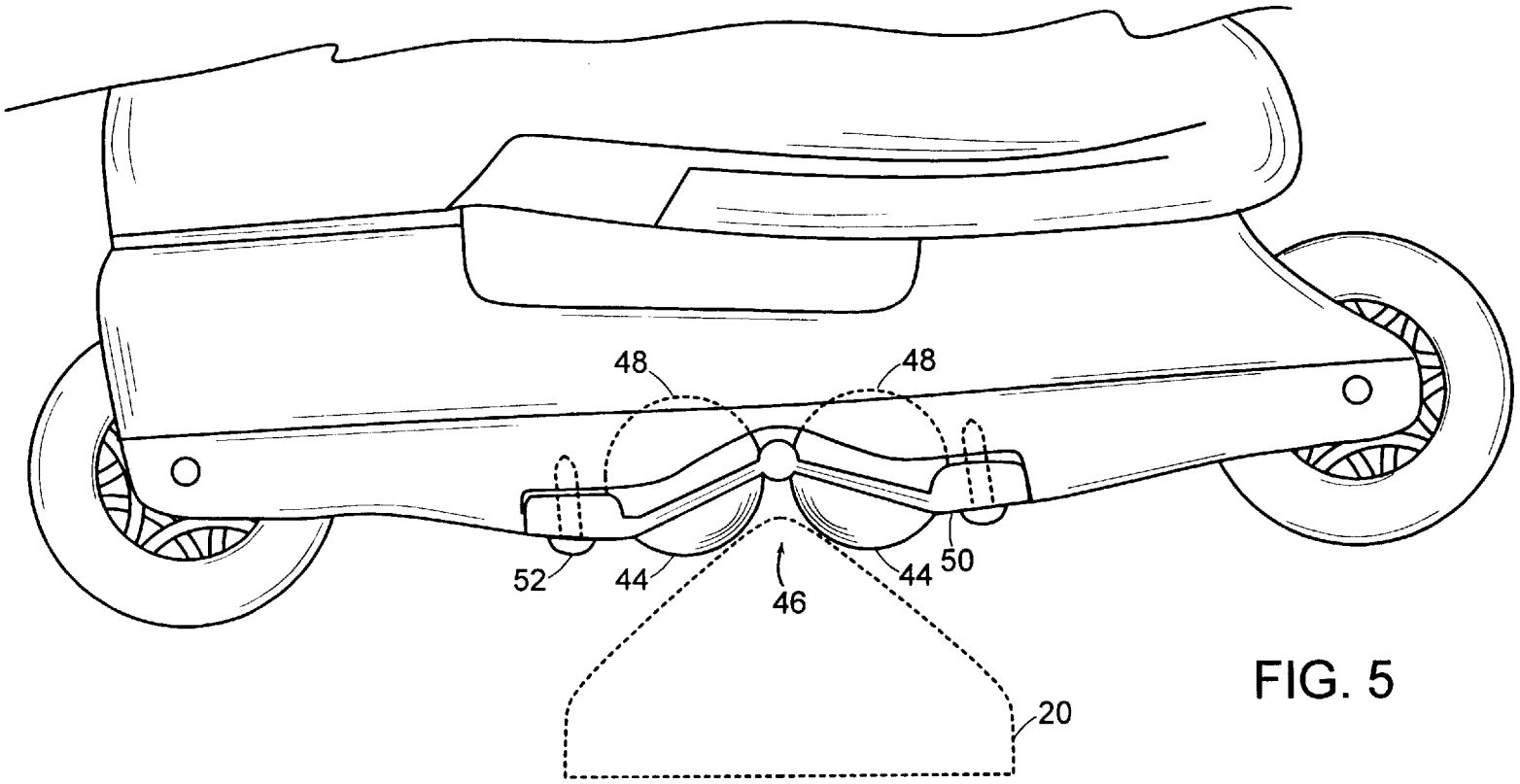
FIGS. 5 and 6 are a side elevation and a bottom view, respectively, of a second embodiment.
Figure 6:
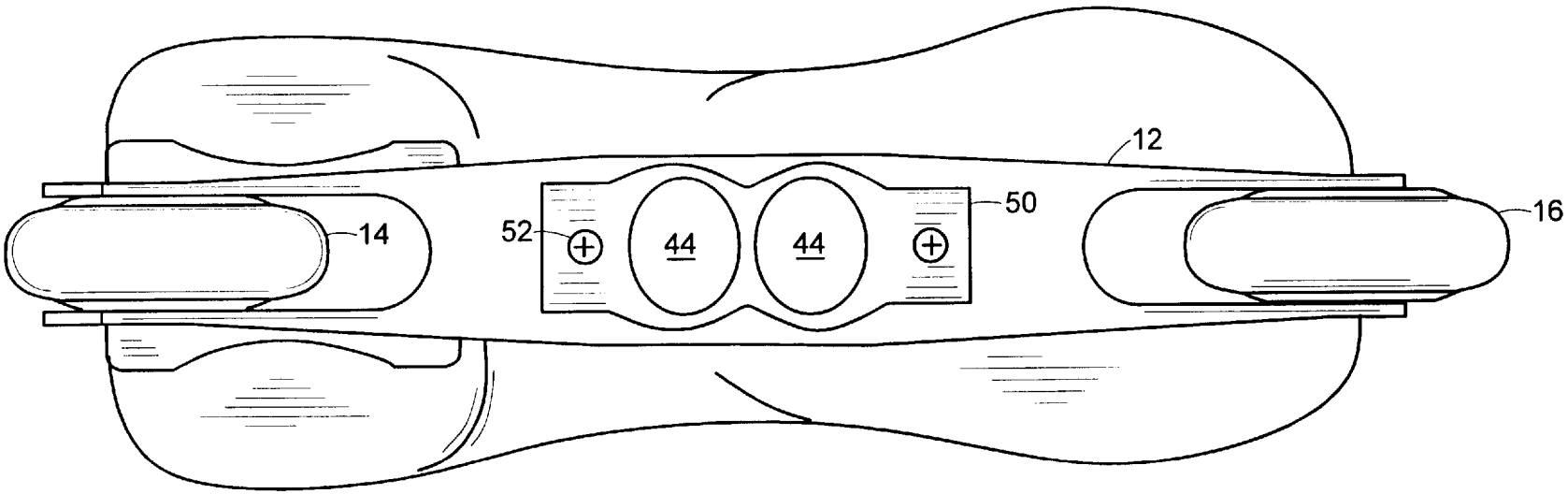

In another embodiment, illustrated in FIGS. 5 and 6, two spherical (or in other embodiments, substantially egg-shaped) roller balls 44 are employed in place of the cylindrical roller 18. In this case, the skater jumps onto the rail such that the rail 20 is positioned in the area between the two roller balls, as shown. The effective groove or indentation 46 defined between the balls helps to keep the skater positioned on the rail. The roller balls are held against cup-shaped seats 48 by a retaining clamp 50. The seats are preferably formed in the skate frame. The force that the clamp applies to push the balls against the seats is adjustable by tightening the pair of clamp mounting screws 52 to adjust the amount of braking.

As shown, the roller balls 44 are recessed from the contact plane defined by the contact of the outer two wheels with the pavement. In another embodiment, the roller balls 44 are mounted lower such that they provide additional support against the pavement for forward motion, as well as sideways motion on a rail, and in certain instances, enable sideways motion on a flat surface while the outer wheels slide or grind.

Figure 7:
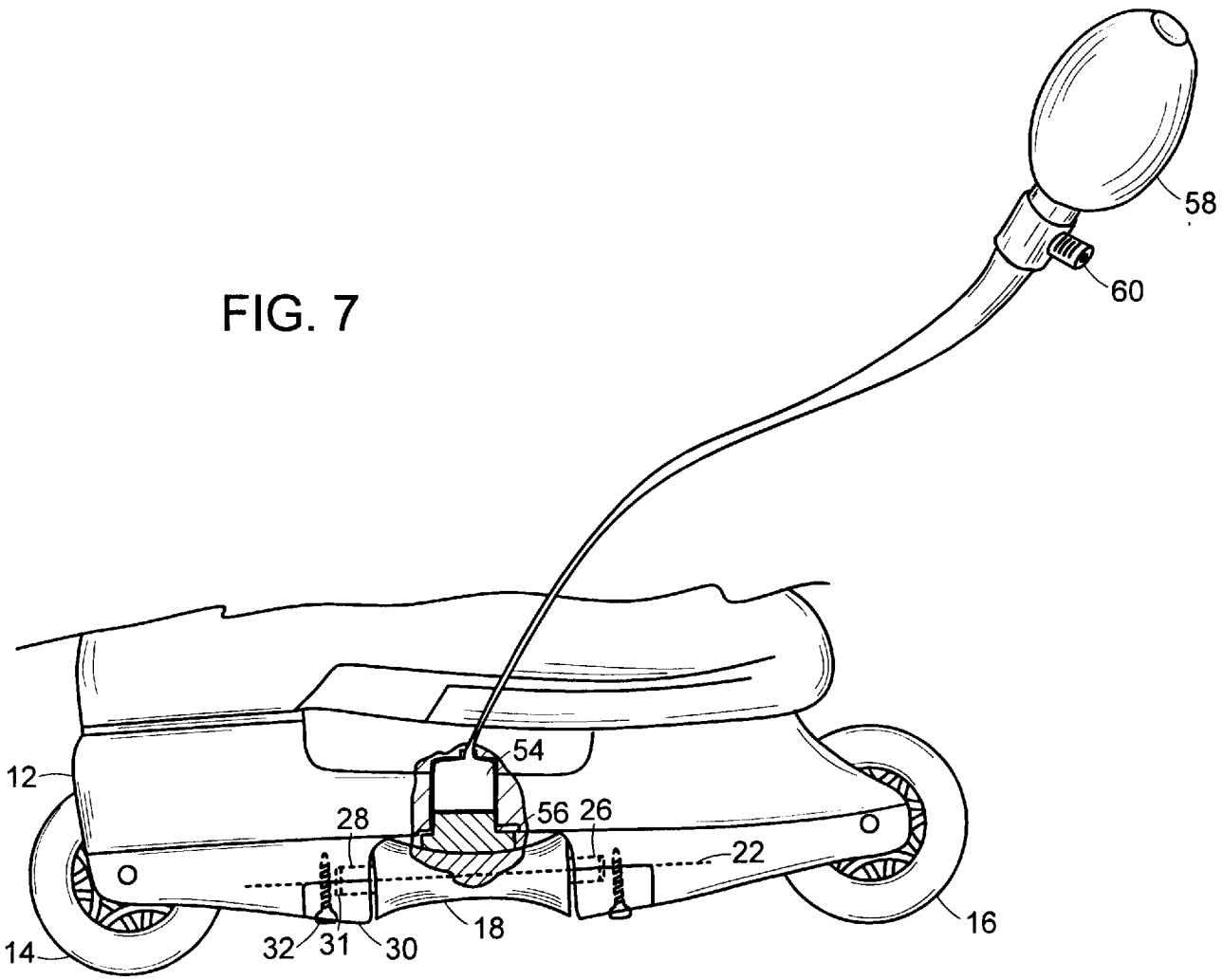
FIG. 7 illustrates an adjustable pneumatic brake.

In another instance the braking force is dynamically manipulatable by the skater while skating. The brake force is transferred by fluid pressure, as is schematically illustrated in FIG. 7. A pneumatic or hydraulic cylinder 54 applies pressure to a brake 56 in contact with the roller 18 in response to fluid pressure in the cylinder. The fluid pressure in this essentially closed system is adjustable by a remote manually operated pump, such as a squeeze-bulb 58, and a manually operated bleed valve 60. When the skater wants to increase braking, squeezing the bulb 58 increases the force of the brake against the roller. When it is desired to reduce braking, the valve 60 is opened temporarily to relieve pressure.

In another embodiment, the braking force is modulated in a dynamic manner by continual regulation of the pressure in the squeeze bulb 58 or other pressure transfer device.

Figure 8:
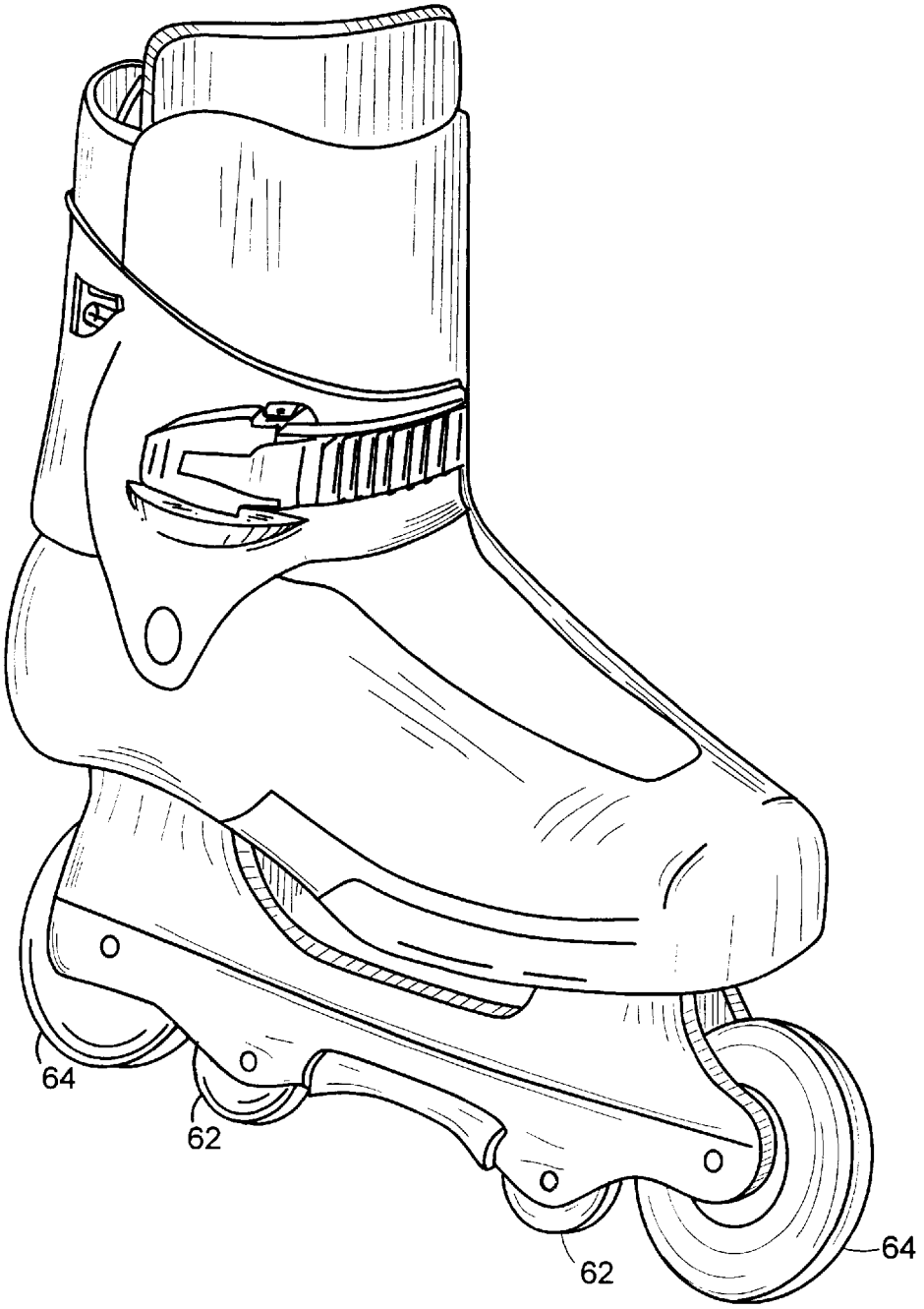
FIG. 8 is a perspective view of a so-called "extreme skate"
Figure 9A:
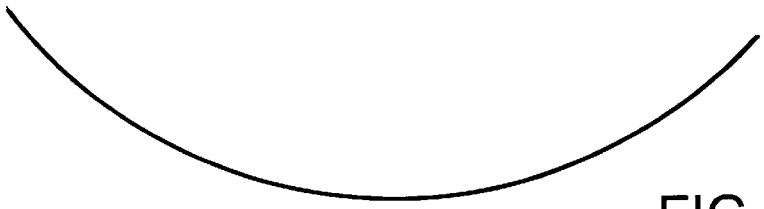
FIG. 9A–9F illustrates some rail configurations on which the skate of the present invention may be used.
Figure 9B:
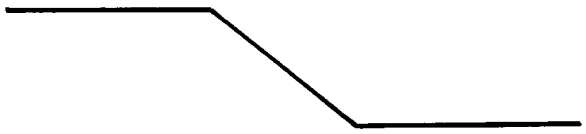
Figure 9C:
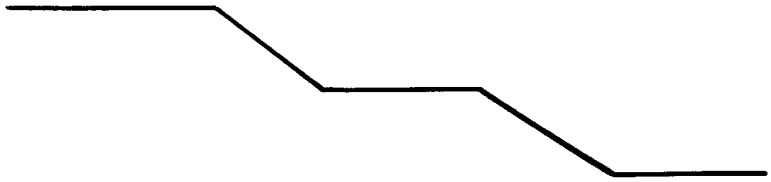
Figure 9D:
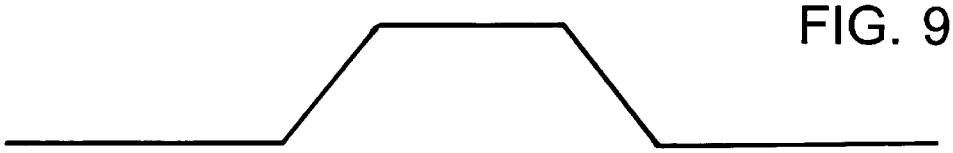
Figure 9E:
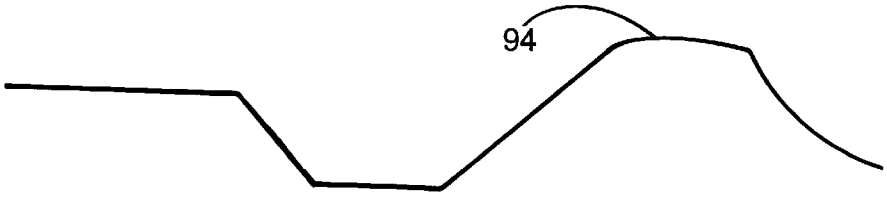
Figure 9F:
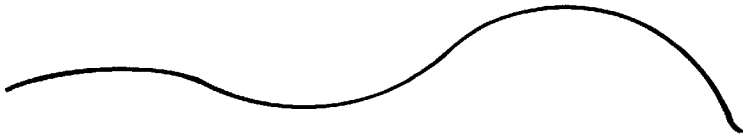

In another configuration referred to as 'extreme skates', the inner two wheels 62 of a four-wheel in-line skate are smaller than the outer two wheels 64, leaving room between the inner two wheels to incorporate the roller, as shown in FIG. 8.

The lower friction of the rolling element(s) as compared to a grinding plate increases the range of rail speeds achievable with in-line skates, making it possible to perform on rails of more varied form. With the roller device of this invention, a skater can experience rides comparable to roller coaster rides, as the skater goes along the curves and angles on the railings illustrated in FIGS. 9A–9F. Because of electively reduced braking, the momentum of the skater is preserved during a "down run" 66 to enable a following "up run" 68 and so on, thus extending the ride, thrill and enjoyment of extreme skating maneuvers. Sliding down the types of rail configurations shown in FIGS. 9A–9F, including up inclines, is not practical or achievable with grinding plates because they develop too much friction and slow the skater too much.

Figure 10:
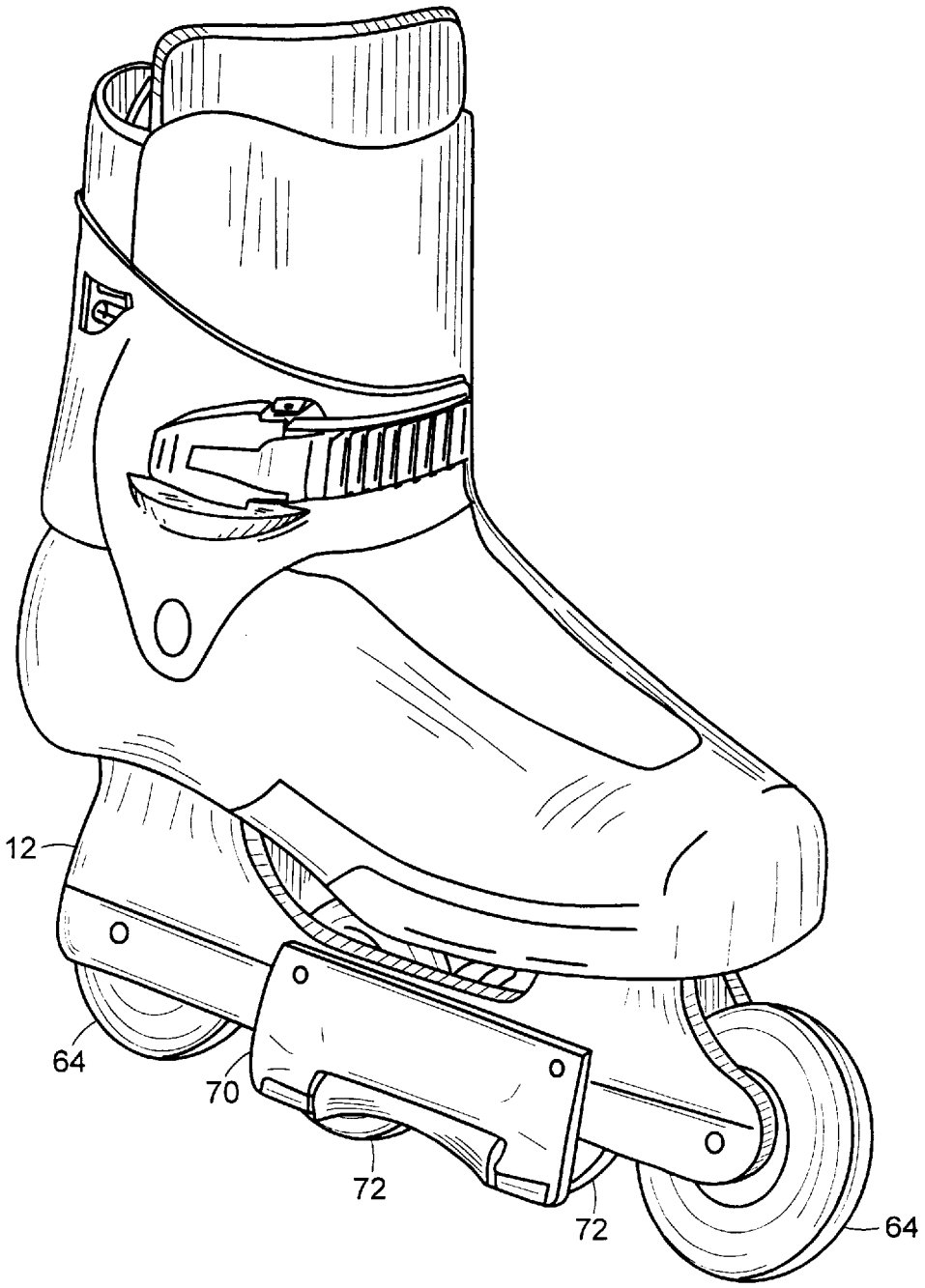
FIG. 10 illustrates an attachment for an in-line skate.
Figure 11A:
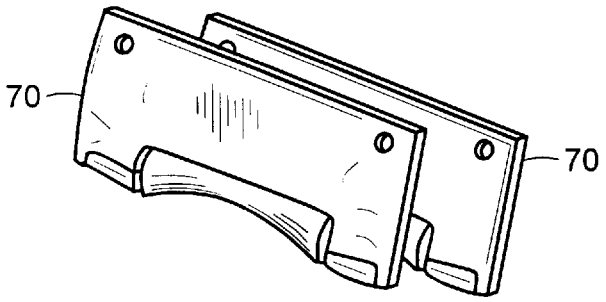
FIGS. 11A through 11C show different embodiments of the attachment shown in FIG. 10.

In an advantageous aspect of the invention, the rolling element is provided as part of an attachment that is constructed to be secured to an in-line skate. In this manner, the benefits of the invention may be derived with skates not originally designed or built with "extreme skating" in mind, as well as in skates designed for conventional and extreme skating, by use of the attachment. As illustrated in FIGS. 10 and 11A, the attachment 70 is secured in a load bearing relationship to the lower structure, such as the wheel frame 12, of an in-line skate. The rolling element(s) in this case, of either elongated or spherical form, are mounted to one side or both of the frame to provide clearance for the wheels.

Figure 11B:
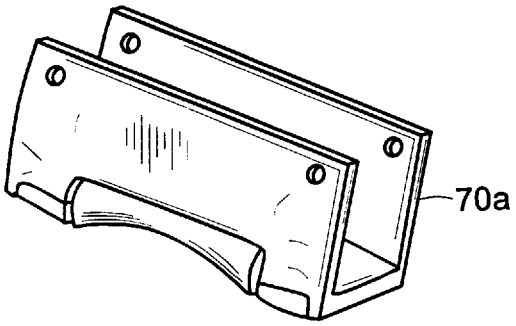
Figure 11C:
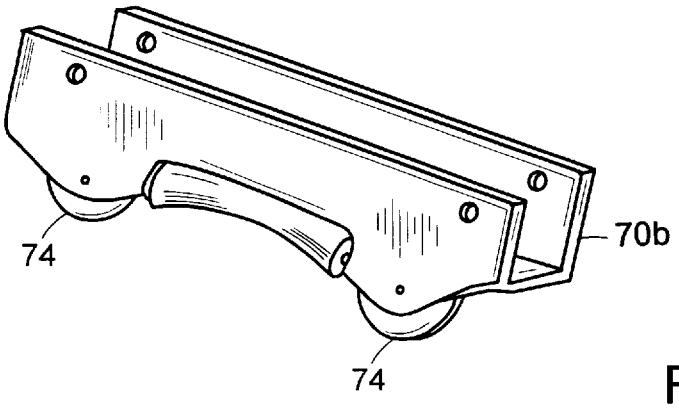

In other embodiments, two of which are illustrated in Figs. 11B and 11C, the attachment 70A or 70B, respectively, replaces the centrally located wheels 72, the rolling element preferably being positioned in-line with the skate wheels. In the embodiment shown in FIG. 11C, the attachment includes relatively small wheels 74, also in-line with the skate wheels, to replace the removed center wheels.

Figure 12:
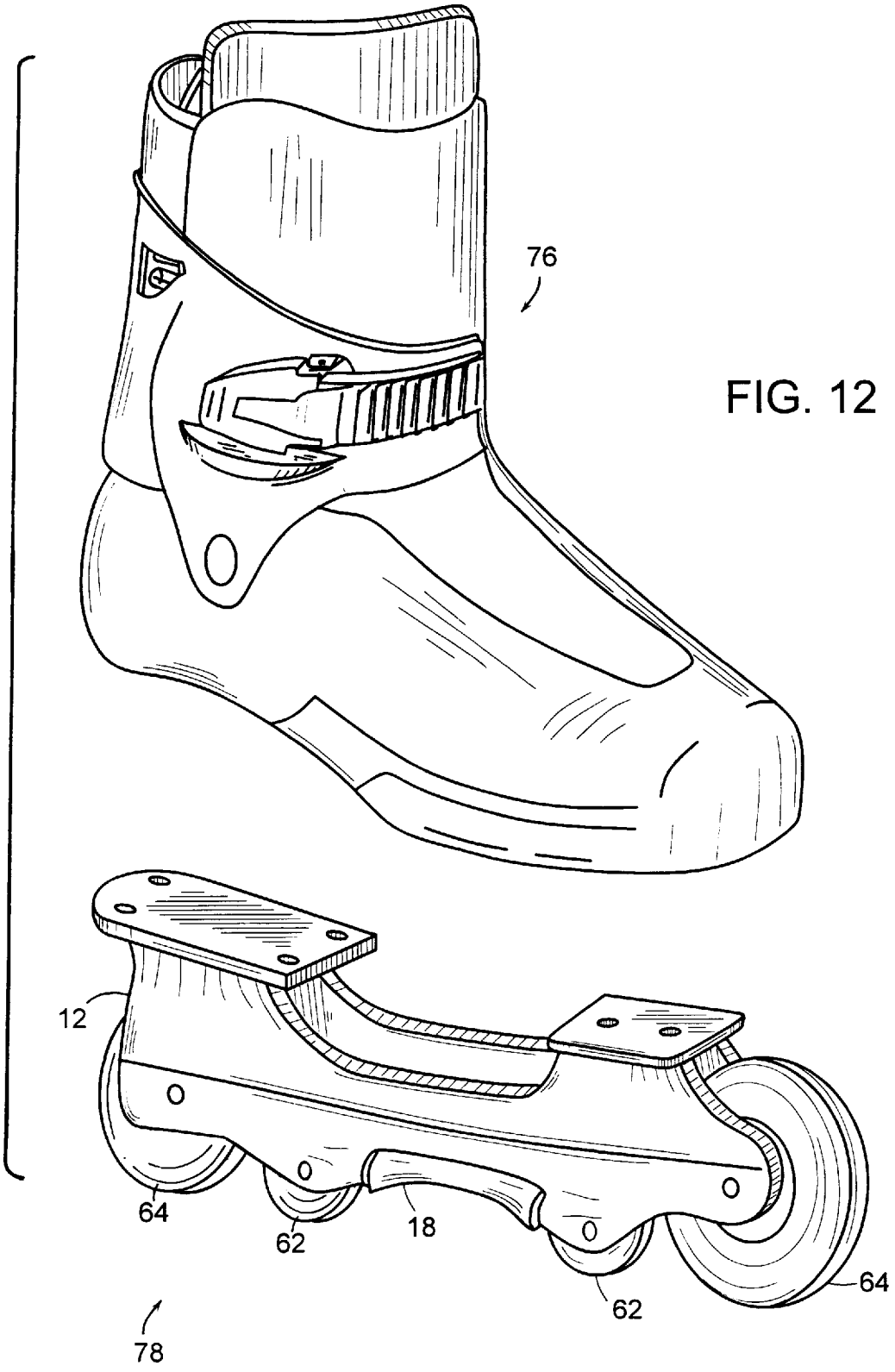
FIG. 12 is a perspective view of a lower structure and a boot portion of an in-line skate.

As shown in FIG. 12, another embodiment provides a rolling element for extreme skating as part of an entire lower structure 78 that includes a skate frame 12, wheels 64 and rolling element 18. The lower structure is securable to the boot portion 76 of an in-line skate, and may be used with boot portions not originally designed or built with extreme skating in mind.

The safety of extreme skating is improved in certain aspects by the addition of the rolling element that avoids the excessive wear and consequential breakage of grinding plates which can cause accidents.

Many other embodiments will occur to those skilled in the art, and are within the scope of the following claims.

What is claimed is:

1. An in-line wheeled skate comprising an elongated frame extending in a longitudinal direction of travel of the skate;

a pair of longitudinally spaced wheels positioned in-line along the frame, each wheel being mounted to the frame for rotation about a fixed axis of rotation extending perpendicular to the longitudinal direction of said frame, the pair of wheels adapted to roll in the longitudinal direction of the frame upon a ground plane defined by lowermost portions of the wheels; and an elongated roller positioned between said pair of wheels, the roller being mounted to said frame for rotation about a single axis extending in the longitudinal direction of the frame, the rotational axis of the roller being disposed between left and right longitudinal side planes defined by left and right lateral sides of said pair of wheels, the roller having an outer engagement surface configured for rolling contact with an elongated supporting surface extending transversely between the pair of wheels for permitting the skate to travel in a direction extending perpendicular to the longitudinal direction of said frame, a lowermost portion of the outer engagement surface of the roller being positioned vertically higher than the ground plane of the wheels.

2. The in-line wheeled skate of claim 1, further comprising a second pair of wheels positioned in-line along said frame with said roller therebetween, each wheel of said second pair of wheels being mounted for rotation about a fixed axis of rotation extending perpendicular to the longitudinal direction of said frame.

3. The in-line wheeled skate of claim 1, wherein the outer engagement surface of the roller is concave, such that the roller has a minimum diameter at its midpoint.

4. The in-line wheeled skate of claim 1 wherein the rotational axis of the roller is centered between said left and right longitudinal side planes.

* * * * *